US006503642B1

(12) United States Patent
Linde

(10) Patent No.: US 6,503,642 B1
(45) Date of Patent: Jan. 7, 2003

(54) HARD-CHROME PLATED LAYER

(75) Inventor: Rudolf Linde, Wermelskirchen (DE)

(73) Assignee: Federal Mogul Burscheid GmbH, Burscheid (DE)

( * ) Notice: Subject to any disclaimer, the term of this patent is extended or adjusted under 35 U.S.C. 154(b) by 2 days.

(21) Appl. No.: 09/786,570

(22) PCT Filed: Jun. 15, 2000

(86) PCT No.: PCT/EP00/05524

§ 371 (c)(1),
(2), (4) Date: Mar. 7, 2001

(87) PCT Pub. No.: WO01/04386

PCT Pub. Date: Jan. 18, 2001

(30) Foreign Application Priority Data

Jul. 8, 1999 (DE) ..... 199 31 829

(51) Int. Cl.[7] ..... B32B 15/00; C25D 15/00

(52) U.S. Cl. ..... 428/666; 29/888.074; 205/109; 205/113; 205/243; 205/283; 428/610; 428/613; 428/614; 428/636; 428/908.8; 428/926; 428/935

(58) Field of Search ..... 428/666, 636, 428/614, 613, 610, 908.8, 926, 935; 29/888.074; 205/109, 113, 283, 243

(56) References Cited

U.S. PATENT DOCUMENTS 4,846,940 A * 7/1989 Neuhauser et al. ..... 205/109

FOREIGN PATENT DOCUMENTS

| | | |
|---|---|---|
| DE | 197 45 811 | 4/1999 |
| EP | 0 217 126 | 4/1987 |
| EP | 0 386 245 | 9/1990 |
| EP | 0 668 375 | 8/1995 |
| EP | 0 741 195 | 11/1996 |
| EP | 0 841 413 | 5/1998 |
| EP | 0 841 414 | 5/1998 |
| EP | 0 909 839 | 4/1999 |

OTHER PUBLICATIONS

Derwent Publications Ltd., London GB, (XP002150562) JP 62 120498 [M. Takaya] Jun. 1, 1987.
Patent Abstract of Japan, vol. 014, No. 395 (M–1016) JP 02 150574 [Riken Corp] Jun. 8, 1990.

* cited by examiner

*Primary Examiner*—Robert R. Koehler
(74) *Attorney, Agent, or Firm*—Reed Smith LLP

(57) ABSTRACT

In an electrodeposited hard-chromium coat, particularly for a piston ring, which is substantially formed of an electrolyte containing hexavalent chromium, wherein there are cracks in the coat and diamond particles are embedded in these cracks, the diamond particles have a size ranging from 0.25 to 0.5 $\mu$m.

15 Claims, No Drawings

HARD-CHROME PLATED LAYER

CROSS-REFERENCES TO RELATED APPLICATIONS

This application claims Paris Convention priority of German Application No. 199 31 829.8 filed Jul. 8, 1999 and International Application No. PCT/EP00/05524 filed Jun. 15, 2000, the complete disclosure of which is(are) hereby incorporated by reference.

BACKGROUND OF THE INVENTION a) Field of the Invention

The invention is directed to an electrodeposited hard-chromium coat, particularly for a piston ring, which is substantially formed of an electrolyte containing hexavalent chromium, wherein there are cracks in the coat and diamond particles are embedded in these cracks.

b) Description of the Related Art

Electrodeposited hard-chromium coats have been known from the prior art for a long time and are used, for example, as surface coating in shock absorber pistons, hydraulic parts, piston rings and printing rollers.

Although electrodeposition of chromium still requires a relatively large amount of energy, electrodeposited chromium is very economical in terms of utilization of resources, since virtually 100% of the chromium electrolyte can also be deposited as a chromium coat; this is why chromium electroplating is still frequently used today.

European Patent EP 0 217 126 describes an electrodeposited hard-chromium coat of the type mentioned above with a network of cracks extending through the entire thickness of the coat, wherein solids particles are embedded in these cracks. A chromium coat of this type is produced by microcrack-forming chromium plating baths, known per se, preferably chromic acid baths, with solids particles dispersed therein. During chromium plating, the workpiece to be chromium-plated is first cathode-connected so that a chromium coat with microcracks is formed, and the workpiece is then anode-connected so that the microcracks expand to the desired gap width and the cracks fill with solids particles. This is followed by cathode switching again, so that the solids particles are encapsulated and enclosed by the closing of the cracks. This cyclical reversal of current can be repeated a number of times, if required, wherein the chromium plating parameters can be varied in accordance with the application such that the desired crack width, crack density and crack filling takes place, possibly with different solids particles filling.

European Patent EP 0 668 375 B1 discloses a process for producing a hard chromium composite coating on a substrate comprising a disperse phase and is particularly suited for mechanical components that are subjected to high-temperature friction. This process comprises the step of electrodeposition of at least one hard-chromium coat in a chromium plating bath of the type which forms microcracks and which contains a suspension of a predetermined concentration of particles of a given size of a nonmetal which is insoluble in the bath. At the same time, in the course of said deposition step, the substrate is permanently maintained at cathode potential and a pulsating cathode current which cycles over time between a minimum value and maximum value is supplied in order to achieve a chromium coat comprising a matrix with microcracks having a given distribution and a disperse phase comprising said nonmetal particles, some of which are enclosed in the microcracks while some are embedded directly in the matrix. The chromium plating bath is based on chromic acid and contains predominantly hexavalent chromium in solution. A coat which is produced by this process and which has a relatively low hydrogen content is also described in this European patent.

Further, European Patent Application EP 0 841 413 A1 discloses a piston ring with a nitrided coat over its entire surface, wherein a chromium composite layer is formed on its surfaces. This coat has a network of cracks formed at its outer surface and internally. Particles of $Si_3N_4$ are enclosed in these cracks; the average size of the $Si_3N_4$ particles is 0.8 to 3 $\mu$m and the dispersion ratio of these particles in the electrolyte is 3 to 15 percent by volume. Improved resistance to frictional wear and corrosion are achieved with a surface coating of this kind.

Another known piston ring which is described in European Patent Application EP 0 841 414 A1 differs from that known from EP 0 841 413 A1 in that round aluminum particles are enclosed in the cracks, wherein the average particle size is between 0.7 and 10 $\mu$m and the dispersion ratio of the round aluminum particles in the electrolyte is 3 to 15 percent by volume.

Finally, the German Offenlegungsschrift, or Laid Open Application, DE 197 45 811 A1 describes an electrodeposited hard-chromium coat with a network of cracks extending partially or completely through the coat thickness and solids particles which are embedded and encapsulated in the cracks. The electrodeposited hard-chromium coat comprises at least two layers of hard chromium, at least one of which is deposited by pulsating DC current, so that the chromium has different forms of crystallization. The hard chromium can be alloyed, in addition, with the metals tungsten, vanadium and/or molybdenum.

OBJECT AND SUMMARY OF THE INVENTION

Proceeding from this known prior art, it is the primary object of the invention to provide an electrodeposited hard-chromium coat having improved physical characteristics such as improved resistance to wear and resistance to corrosion in particular.

This object is met by an electrodeposited hard-chromium coat of the generic type in which the diamond particles have a size ranging from 0.25 to 0.5 $\mu$m.

However, the indicated diamond particle size does not mean that all particles must necessarily have the same size; rather, they can have different sizes and must merely be within the range of 0.25 to 0.5 $\mu$m.

The electrodeposited chromium coat according to the invention is formed substantially from an electrolyte containing hexavalent chromium. In contrast to a chromium formed of trivalent electrolyte, the chromium formed of hexavalent electrolyte has more lattice imperfections because the chromium formed from a hexavalent electrolyte contains, in addition to the body-centered cubic chromium, more hexagonal chromium hydride, which is a result of the extensive hydrogen formation during electrodeposition. This results in a greater number of lattice defects and therefore also in an even greater hardness of the deposited chromium.

The hard-chromium coat according to the invention need not necessarily be pure chromium. On the contrary, alloying of the chromium, especially with the metals molybdenum, vanadium and tungsten, can be advantageous for certain applications.

Surprisingly, through the use of diamond particles ranging in size from 0.25 to 0.5 $\mu$m, coats can be achieved with even better properties compared with particle sizes used according to the known the prior art.

Coatings of electrodeposited hard-chromium coats with $Al_2O_3$ particles which range in size from 2 to 5 μm and are embedded in the network of cracks were formerly commonly used for piston rings. These coats formerly showed the best characteristics with respect to wear resistance and corrosion resistance.

Tests with diamond particles met with little success previously because only electrodeposited hard-chromium coats which have inferior characteristics compared with coats formed with aluminum oxide particles and which are also substantially more expensive could be achieved using diamond particles with sizes from 2 to 5 μm as is conventional for aluminum oxide particles.

In a test under engine conditions, piston rings provided with a coating according to the invention were used in a 6-cylinder turbo diesel engine under full load for 85 hours. Results showed that with cylinder wear of approximately 0.17 μm/1000 km, which is approximately the same as in formerly used electrodeposited chromium coats with aluminum oxide particles, ring wear was reduced by half with the electrodeposited hard-chromium coat according to the invention, other conditions remaining the same, namely, ring wear of only 0.2 μm/1000 km occurred compared with 0.5 μm/1000 km using a conventional electrodeposited hard-chromium coat with aluminum oxide particles as piston ring coating.

In addition, it was shown in a simulated test for corrosion resistance that a diamond-embedded chromium coat with particle sizes ranging from 0.25 to 0.5 μm (as required according to the invention) showed a greater than 20% improvement in corrosion resistance compared with formerly used chromium coats with embedded aluminum oxide particles ranging in size from 2 to 5 μm, namely, an improvement of 160% compared to 130% with the chromium coat with aluminum oxide particles.

Also, with respect to burn trace resistance, the results achieved with the electrodeposited hard-chromium coat according to the invention were appreciably better compared with coatings such as those previously applied.

Further, an electrodeposited hard-chromium coat according to the invention with embedded diamond particles shows greatly improved characteristics at high thermal loads, below which the formerly used coats with aluminum oxide particles could reach their useful limits. At higher temperatures, diamond is transformed into graphite. When high pressures occur in conjunction with deficient lubrication, the temperature of the coat, which is applied, e.g., to the running surface of a piston ring, can be so high that burn traces are formed. However, in this situation the diamond particles are advantageously transformed into graphite which then takes over lubricating functions so as to prevent burn traces. Accordingly, the coat according to the invention also possesses very good emergency characteristics, particularly due to the transformation of diamond into graphite at temperatures of about 700° C. or higher.

The hard-chromium coat according to the invention can preferably be produced through the use of chromium plating baths, known per se, with solids particles dispersed therein, as has been known for a long time from the prior art. During the chromium plating, the workpiece to be chromium plated is first switched to cathode so that a microcracked hard-chromium coat is formed, after which the workpiece is switched to anode, so that the microcracks expand to the desired gap width and the cracks are filled with diamond particles.

If the hard-chromium coat according to the invention is not pure chromium but, rather, is formed by alloying, the alloying elements are dissolved as salts in the chromium plating electrolyte and are electrodeposited with the chromium. The amount of alloying elements present in the chromium coat is preferably 0.1 to 30 percent by weight. Such coats are even more resistant to wear and more ductile than pure chromium coats.

The total thickness of the electrodeposited hard-chromium coat according to the invention should preferably be greater by a multiple than the size of the particles. This is desirable so that the particles can be embedded completely in the network of cracks formed in the hard-chromium coat and so that not only individual particles will be only partly embedded in the chromium coat. Usually, it is also desirable for the cracks to be filled with many diamond particles.

Particularly advantageous results can be achieved when the thickness of the hard-chromium coat according to the invention is preferably between 0.0005 and 1.0 mm.

The gap width of the cracks in the electrodeposited chromium coat according to the invention should be larger than the particles to be embedded, and may be greater than 0.001. A preferred gap width of the cracks of the electrodeposited hard-chromium coat according to the invention is greater than 0.3 μm, particularly, greater than 0.5 μm, in order that solids particles can be embedded in the cracks at all and so that the cracks are not too small for the diamond particles.

It has been shown that particularly excellent characteristics can be achieved in the hard-chromium coat according to the invention when they comprise at least two chromium coat layers. It has been observed that the cracks are not always formed continuously in the chromium coat. When thinner coats are applied and the particles are introduced into the cracks of the individual coats, a coating can be achieved which has a better distribution of diamond particles through the entire thickness and along the entire surface of the coating, since the cracks are not always formed at the same locations.

The thickness of the individual layers is preferably approximately 0.0005 to 0.5 mm.

When the hard-chromium coat according to the invention comprises at least two layers, the individual coats can also have alloying constituents of different levels or completely different alloying constituents. This can be selected in a suitable manner depending on requirements for the coat or for the workpiece to be coated.

When the electrodeposited chromium coat is formed in such a way that the at least two chromium coat layers have a different crystal structure, the strength characteristics of the coat according to the invention can be improved even further. In order to produce at least one layer of hard chromium, the chromium is deposited from the electrolyte to the cathode-connected workpiece with pulsating DC current at current densities between 5 and 250 $A/dm^2$, so that a plurality of layers of hard chromium with different forms of crystallization are deposited in the chromium layer corresponding to the current density. After each deposition phase of a layer, the workpiece is connected to the anode, so that the network of cracks in the hard chromium expands and is filled with the solids particles.

The coats with different crystal structures are preferably alternately deposited one upon the other.

An electrodeposited hard-chromium coat of this type, according to the invention, showed further improved characteristics such as longer useful life at extreme temperatures and wear stresses. This may perhaps be due to the fact that high lattice stresses occur, particularly at the interfaces or boundary surfaces, due to the different crystal structures of the two coats, so that not only is the coat harder as a whole, but other mechanical characteristics of the electrodeposited hard-chromium coat according to the invention are also improved.

It has been shown that the electrodeposited hard-chromium coat according to the invention has excellent characteristics, preferably very good corrosion resistance and wear resistance, particularly when the selected content of diamond particles in the chromium coat is not too high. The coat according to the invention has especially good characteristics when the proportion of diamond particles in the chromium coat is 0.1 to 10 percent by weight.

In a preferred embodiment form of the invention, additional hard material particles are embedded in the cracks in the electrodeposited chromium coat in addition to the diamond particles. These other hard material particles can include any hard material particles familiar to the person skilled in the art, but especially tungsten carbide, chromium carbide, aluminum oxide, silicon carbide, silicon nitride, boron carbide and/or cubic boron nitride.

Embedding of additional hard material particles may be advantageous, for example, when high pressures coincide with deficient lubrication when the temperature, e.g., at the running surface of the piston ring for which the coats according to the invention can be used, for instance, is so high that the diamond particles are transformed into graphite and take on lubricating functions. At this point, however, the diamond by itself can no longer serve to improve wear resistance. It is here that the excellent properties of the hard material particles which are present in addition to the diamond come to the fore and prevent unnecessarily high wear of the electrodeposited hard-chromium coat according to the invention.

Further, solid lubricant particles, solids particles for increasing ductility and corrosion resistance and/or solids particles as dyes can be advantageously contained in the cracks in the electrodeposited hard-chromium coat according to the invention. By embedding additional particles besides the hard material particles, the coat according to the invention can be suitably adapted for the application at hand. For example, hexagonal boron nitride, graphite and/or polymer particles, especially polyethylene and/or polytetrafluoroethylene can be introduced into the cracks, in addition, as solid lubricant particles.

Ductile metals or metal alloys of tin, titanium or aluminum can be embedded in order to increase the ductility of the hard-chromium coat according to the invention.

To increase corrosion resistance, the cracks can be filled with polyethylene, for example, and this polyethylene can then be melted in the cracks so that the cracks are sealed by it and are protected against corrosion.

Different particles other than diamond particles can also be used for filling the cracks.

The diamond particles which are embedded in the electrodeposited chromium coat are advantageously formed of monocrystalline and/or polycrystalline diamond. While polycrystalline diamond, which can only be produced synthetically, is currently more expensive than monocrystalline diamond, better results are achieved with polycrystalline diamond because a polycrystalline diamond has many sliding planes due to the many different crystals.

However, because of the high wear resistance of the electrodeposited chromium according to the invention, the running-in of the coat progresses relatively slowly. This is not so desirable especially when the coat is used on piston rings, since there can be negative consequences with respect to oil consumption and emissions in this phase. Improvements can be achieved in this respect with special surface topographies, e.g., as realized by special lapping, and/or with the development of piston ring coatings with improved running-in which are to be applied galvanically to the wear-resistant base coats by means of PVD or CVD or other methods familiar to the person skilled in the art.

A dispersion coat based on nickel-cobalt-phosphorus with silicon nitride as dispersing agent which ensures the necessary quick running-in and provides excellent protection against burn traces can be used for this purpose in particular.

A further possibility for improving the running-in behavior of the diamond-embedded electrodeposited chromium coat according to the invention consists in graduating the coat. The graduation can be selected in such a way, for example, that it has reduced solids content on its running surface. The solids content can decrease from the inside toward the outside and may not even be present at all in the outermost coating area in the coat according to the invention.

However, the solids content can also increase in the direction of the free surface of the hard-chromium coat. Further, the coat according to the invention can also have a graduation of lubricants and/or other particles contained in the coat.

Depending on the use of the electrodeposited hard-chromium coat according to the invention, it can also be advantageous when surface-hardening is carried out in addition. Nitriding is preferred for this purpose because it can be carried out with very good definition, i.e., either the entire surface or only certain, exactly defined areas can be nitrided. Nitriding of surfaces is usually carried out by means of plasma or glow nitriding. However, the electrodeposited chromium coat according to the invention can also be subjected to surface-hardening by means of ion implantation, for example, with nitrogen.

As was already mentioned, the electrodeposited chromium coat according to the invention can advantageously be used as a running-surface coating for machine parts which are subject to high temperature and wear and is accordingly particularly preferred for piston rings, since it has proven particularly successful with respect to friction wear and use at high temperatures.

In the following, the invention will be explained more fully with reference to preferred embodiment examples.

DESCRIPTION OF THE PREFERRED EMBODIMENTS

EXAMPLE 1

A crack-forming electrolyte containing the following substituents is used for chromium plating:

250 g/l $CrO_3$ chromic acid 1.5 g/l $H_2SO_4$ sulfuric acid 10 g/l $K_2SiF_6$ potassium hexafluorosilicate Monocrystalline diamond particles (50 g/l) with an average particle size of 0.3 to 0.4 $\mu$m are dispersed in the electrolyte by stirring and are held in suspension during the chromium plating.

The chromium plating is carried out at a temperature of 60° C.

The workpiece to be chromium plated is initially connected to cathode in a first step and is chromium plated for 8 minutes at a current density of 65 A/dm$^3$. In a second step, the polarity is reversed and the network of cracks of the previously deposited chromium coat is expanded by connecting the workpiece to anode for one minute at a current density of 60 A/dm$^3$ and the cracks are filled with diamond particles. This cycle, namely, cathode chromium plating for a period of 8 minutes and anode etching for a period of one minute, is repeated a total of 20 times so that a coat with a coat thickness of about 140 $\mu$m is formed with a diamond content of 3 to 5 percent by weight of the entire coat.

EXAMPLE 2

In this case, a crack-forming electrolyte containing 250 g/l $CrO_3$ chromic acid 2.5 g/l $H_2SO_4$ sulfuric acid is used for chromium plating, and polycrystalline diamond particles (35 g/l) with an average particle size of 0.3 to 0.4 $\mu$m and aluminum oxide particles (15 g/l) with an average particle size of 3 $\mu$m are dispersed in the electrolyte by stirring and held in suspension during the chromium plating.

The chromium plating is carried out at a temperature of 55° C. for a total of 5 hours while forming a chromium coat with a total thickness of 0.2 mm. The workpiece to be chromium plated is initially connected to cathode in a first step and is chromium plated for 30 minutes at a current density of 65 A/dm$^3$. In a second step, the polarity is reversed and the network of cracks of the previously deposited chromium coat is expanded by connecting the workpiece to anode for 30 seconds at a current density of 150 A/dm$^3$ and the cracks are filled with diamond particles and aluminum oxide particles. This cycle is repeated a total of 10 times so that a coat with a thickness of about 145 $\mu$m is formed with a diamond content of 1 to 5 percent by weight of the entire coat.

While the foregoing description and drawings represent the present invention, it will be obvious to those skilled in the art that various changes may be made therein without departing from the true spirit and scope of the present invention.

What is claimed is:

1. A coating comprising an electrodeposited hard-chromium coat substantially formed of an electrolyte containing hexovalent chromium, the coating having cracks therein and having diamond particle having a size ranging from 0.25 to 0.4 microns embedded in said cracks.

2. The coating of claim 1, which further comprises alloying elements.

3. The coating of claim 1 having a thickness between 0.0005 and 1.0 mm.

4. The coating of claim 1 wherein the gap width of the cracks is greater than 0.001 mm.

5. The coating of claim 1 comprising at least two chromium layers.

6. The coating of claim 5 wherein the chromium layers have different crystal structures.

7. The coating of claim 5 wherein the amount of diamond particles in the chromium coat is 0.1 to 10% by weight.

8. The coating of claim 5 which further comprises hard material particles embedded in the cracks in addition to the diamond particles.

9. The coating of claim 8 wherein the hard material particles contain the compound selected from the group consisting of tungsten carbide, chromium carbide, aluminum oxide, silicon carbide, silicon nitride, boron carbide, cubic boron nitride, and mixtures thereof.

10. The coating of claim 1 which further comprises solid particles selected from the group consisting of lubricant particles, particles for increasing ductility and corrosion resistance, particles as dyes, and mixtures thereof, which solid particles are contained in the cracks in addition to the diamond particles.

11. The coating of claim 1 wherein the diamond particles are formed of monocrystalline diamond, polycrystalline diamond or mixtures thereof.

12. The coating of claim 1 having a running-in coat applied thereover.

13. The coating of claim 12 wherein the running-in coat is an electrodeposited Ni—Co—P alloy coat with embedded silicone nitride.

14. The coating of claim 1 which is graduated.

15. A piston ring having the coating of claim 1 thereon.

* * * * *